11/22/83 XR 4,416,530

United States Patent [19]

Hebert et al.

[11] 4,416,530

[45] Nov. 22, 1983

[54] POLARIZING FILTERS FOR ENHANCING CONTRAST IN XEROGRAPHIC COPYING MACHINES

[75] Inventors: Richard D. Hebert; Daniel J. Lasky, both of San Jose, Calif.

[73] Assignee: Ricoh Company, Ltd., Tokyo, Japan

[21] Appl. No.: 358,369

[22] Filed: Mar. 15, 1982

[51] Int. Cl.[3] ..... G03G 15/00

[52] U.S. Cl. ..... 355/3 R; 355/14 R; 355/71; 350/370

[58] Field of Search ..... 355/3 R, 14 R, 71, 80; 350/15, 370, 372, 374, 379, 380, 392

[56] References Cited

U.S. PATENT DOCUMENTS

| | | | |
|---|---|---|---|
| 3,541,330 | 11/1970 | Eichelberger et al. | 250/65 |
| 3,714,413 | 1/1973 | Craig | 355/71 X |
| 3,801,182 | 4/1974 | Jones | 350/370 X |
| 3,807,830 | 4/1974 | Luke et al. | 350/374 X |
| 3,926,520 | 12/1975 | Kaufman | 355/71 X |
| 4,095,889 | 6/1978 | Goren | 355/71 X |
| 4,153,335 | 5/1979 | Buchan | 350/374 |

*Primary Examiner*—A. C. Prescott

*Attorney, Agent, or Firm*—Flehr, Hohbach, Test, Albritton & Herbert

[57] ABSTRACT

A method for minimizing specular light reflection on copies produced in photocopying machines is provided wherein one or two polarizing filters are located within the photocopying machine.

24 Claims, 12 Drawing Figures

POLARIZING FILTERS FOR ENHANCING CONTRAST IN XEROGRAPHIC COPYING MACHINES

Figure 1A:
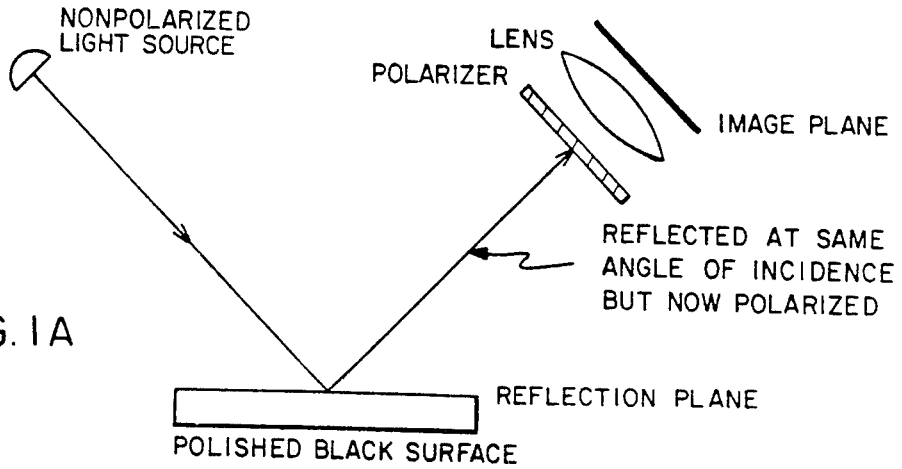

This invention is directed to a method and means to minimizing specular light reflection on copies produced in photocopying machines, more particularly to such method wherein such means is provided by one or two polarizing filters.

Many times in the use of copying machines it is necessary to reproduce copies of copies. It is necessary to provide in the copying system a means for multiple generation copying, however such multiple generation copying has heretofore led to a break down in the image resolution and early loss of information content. We have found that this loss of resolution and reduction in legibility of multiple generation copies relates primarily to specular reflections from images produced by copying machines. These specular reflections in the image area have a tendency to discharge in small areas the latented electrostatic image and lead to breaking up of fine detail and eventually their total disappearance. We have also found that these same defects occur with images reproduced from copies made by other devices such as typewriters and offset printing, the two most commonly used originals. Therefore, the invention is drawn to improving copying of copies as well as to copying in general. The invention is preferably used for the copying of copies.

The operation of most conventional photocopying machines requires that light from a light source within the machine be reflected off the original document to be copied onto an image plane comprising a photoreceptor means. A problem encountered with such machines, particularly when the original document to be copied is itself a photocopy, is reduced object-paper contrast due to specular light reflection from the image. Microscopic examination of these originals shows that the printing thereon is composed of black, irregularly shaped, highly specular, reflecting particles. Under the theory of photocopying machines the ideal document to be copied should contain highly absorbent (black) images on a highly reflective (white) background and should appear as unilluminated (black) areas on the discharged areas (by the reflective background) on the photoreceptor, but under practical applications, this is not the case. The surface of the black printing comprises an irregularly shaped layer of particles. At certain angles light incident upon each of these particles is specularly reflected as polarized light. This redirected light, if collected at the photoreceptor of the copying device, has the effect of appearing as white reflected background and reducing the contract of the black areas, thus reducing the density of the black areas on the copy by causing white holes to appear therein.

It is an object of the instant invention to improve the quality of copies made upon photocopying machines by minimizing specular reflection.

According to the instant invention the problem described above of specular light reflection is eliminated by the use of one polarizing filter or two polarizing filters having their polarizing axes oriented at 90° with respect to one another. For the embodiment employing one polarizing filter, the single filter is placed between the reflection plane and the image plane. In the embodiment employing two polarizing filters, one such filter is placed between the source lamp and the reflection plane within a photocopying machine. The other polarizing filter is located between the reflection plane and the image plane in the photocopying machine so as to intercept the reflected rays. Conventional photocopying machines may also contain various optical elements for focusing the light.

Figure 1B:
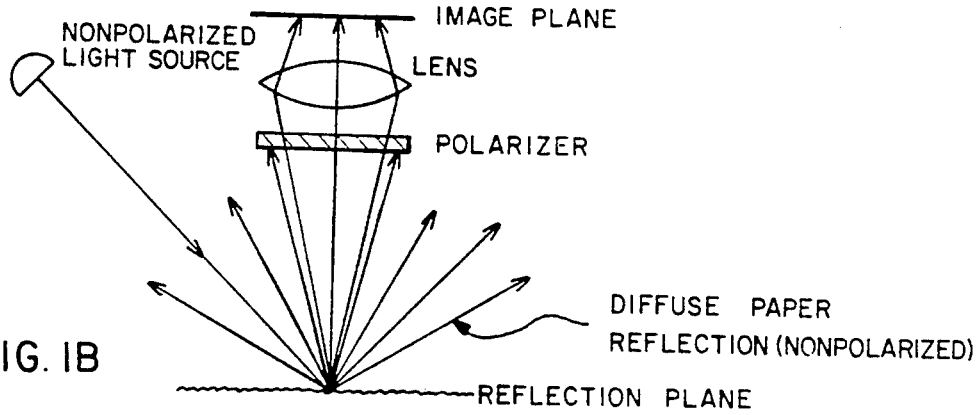
Figure 1C:
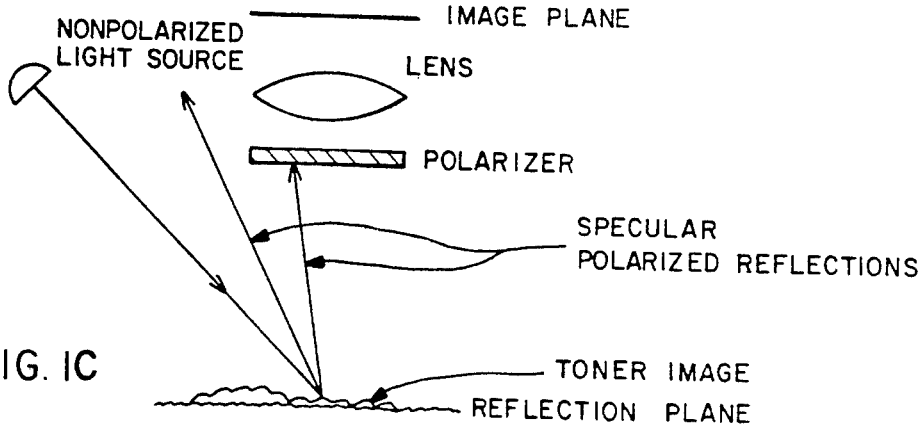

FIGS. 1*a*, 1*b* and 1*c* are diagrams of the geometrics of light scattering applicable to document reproduction.

Figure 2A:
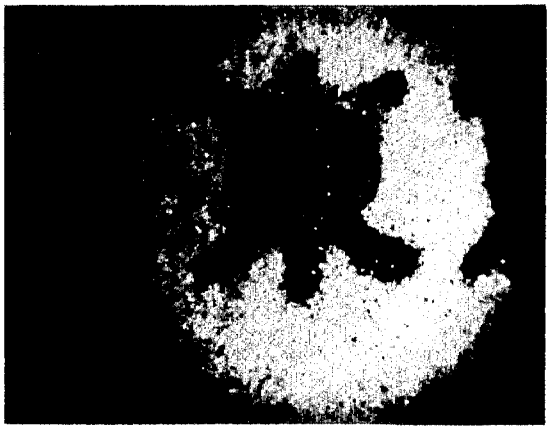
Figure 2B:
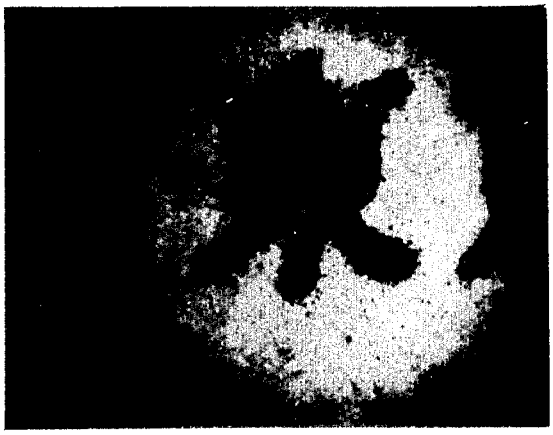

FIGS. 2*a* and 2*b* show two photocopies made of xerographically produced original documents.

Figure 3A:
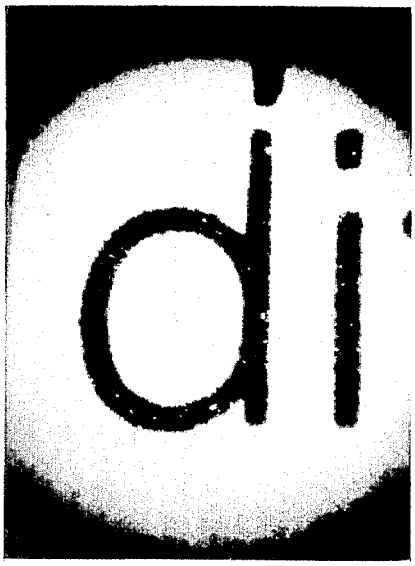
Figure 3B:
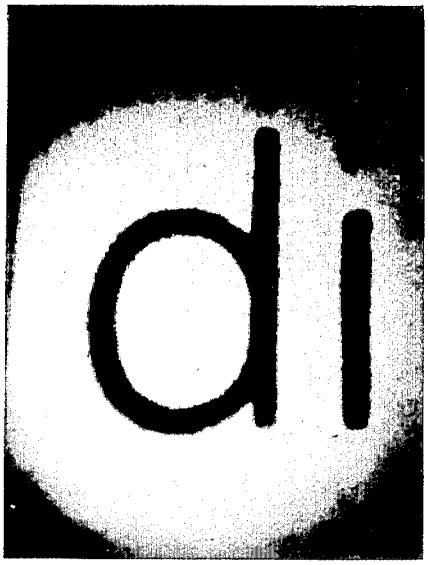

FIGS. 3*a* and 3*b* show two photocopies made of original documents produced by offset printing.

Figure 4A:
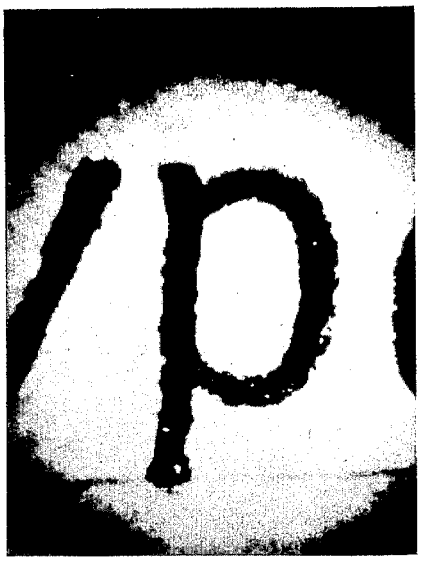
Figure 4B:
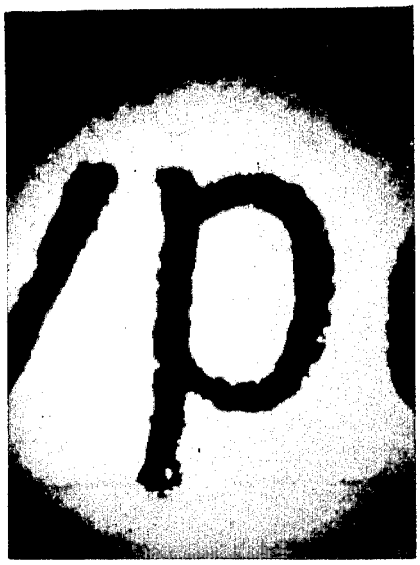

FIGS. 4*a* and 4*b* show two photocopies made of original document produced by impact printing.

Figure 5A:
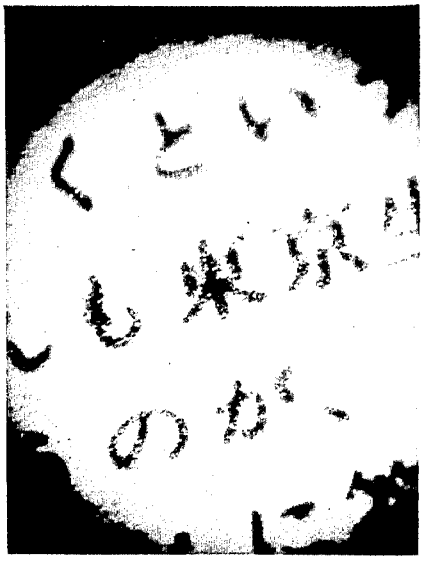
Figure 5B:
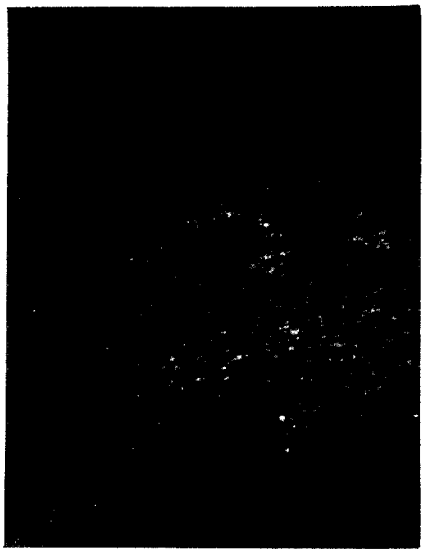
Figure 5C:
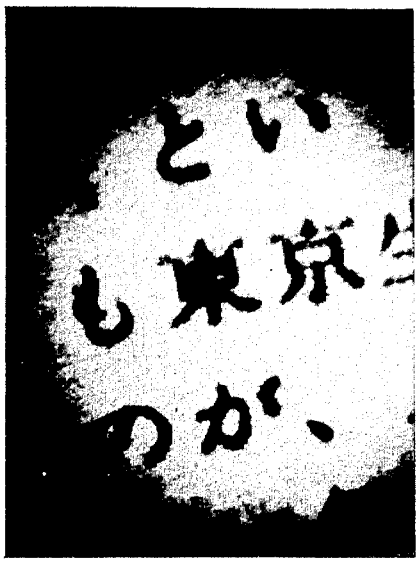

FIG. 5*a* shows a photocopy of an original document wherein the photocopy was made using no polarizing filter and FIGS. 5*b* and 5*c* are photocopies of the same document using one polarizing filter.

Referring to the geometrics shown in FIG. 1, theoretically if the photoreceptor or lens is at the same angle as the non-polarized light source impinging on a smooth, black surface, a polarizer oriented 90° with respect to the polarized reflected light would result in a black image at the image plane (FIG. 1*a*). However, original documents when microscopically viewed, actually comprise the roughened paper (FIG. 1*b*) and black specular areas of ink or toner (FIG. 1*c*). According to FIG. 1*b* non-polarized (or polarized) light which is incident upon the roughened paper surface is scattered and therefore a substantial amount of the light which is reflected off the paper will pass through a polarizer located between the reflection plane and the lens and become incident upon the image plane. However, the polarized reflections off the specular black areas of the (FIG. 1*c*) may be blocked by a polarizer located between the reflection plane and lens having its polarizing axis oriented 90° with respect to the polarized reflections. The result is an image at the image plane exhibiting the effects of minimized specular reflection.

As shown in FIG. 1*c*, even if the source light incident upon the black specular areas of a toner is not polarized, the specular reflections are polarized. Therefore, a single polarizing filter may be placed between the reflection plane and image plane, thereby filtering out at least some of the polarized specular reflections. Alternatively, another polarizer may be added to a location between the non-polarized light source and the reflection plane. Although this would create a polarized light source this would not substantially change the geometrics of FIGS. 1*b* and 1*c*. The scattering (FIG. 1*b*) and specular polarized reflections (FIG. 1*c*) would still occur. The use of two polarizers is more effective in minimizing specular reflections than use of a single polarizer. However, the use of a single polarizer is preferred even though it is less effective in filtering out specular reflection than two polarizers since there is better light intensity received at the image plane.

In the following description the polarizing filter located between the light source and reflection plane of the photocopying machine will be designated as the first filter and the polarizing filter located between the reflection plane and the image plane of a photocopying machine will be designated as the second filter.

FIG. 2 shows images made on an optical bench equipped with two polarizing filters in accordance with the invention. The original document was xerographically reproduced. In both images shown in FIG. 2 the first filter was oriented at 0°. In FIG. 2*a* the second filter was oriented at 0°, whereas in FIG. 2*b* the second filter was oriented at 90°, in accordance with the invention. Notice the absence of bright totally reflecting points in the image areas of the image of FIG. 2*b* as compared with the image of FIG. 2*a*.

FIG. 3 shows images made on a optical bench equipped with two polarizing filters in accordance with the invention. The original document was produced by offset printing. In both images shown in FIG. 3 the first filter was oriented at 0°. In FIG. 3*a* the second filter was oriented at 0°, whereas in FIG. 3*b* the second filter was oriented at 90°, in accordance with the invention. Notice the absence of bright totally reflecting points in the image areas of the image of FIG. 3*b* as compared with the image of FIG. 3*a*.

FIG. 4 shows images made on an optical bench equipped with two polarizing filters in accordance with the invention. The original document was produced by impact printing. In both images shown in FIG. 4 the first filter was oriented at 0°. In FIG. 4*a* the second filter was oriented at 0°, whereas in FIG. 4*b* the second filter was oriented at 90°, in accordance with the invention. Notice the absence of bright totally reflecting points in the image areas of the image of FIG. 4*b* as compared with the image of FIG. 4*a*.

FIG. 5*a* is a picture of a copy made wherein no polarizing filters were used. FIGS. 5*b* and 5*c* are pictures of same image wherein one polarizer was used located between the reflection plane and image plane. In FIG. 5*b*, the single polarizer was oriented at 0°, i.e., an orientation arbitrarily chosen with the polarizing axis parallel to the plane defined by the light source, a point on the reflection plane, and its corresponding print image on the image plane as viewed through the polarizer. In FIG. 5*c*, the single polarizer has been rotated 90° from its orientation in FIG. 5*b*. Note the reduction of the bright specular reflecting spots on the image plane.

As can be seen by FIGS. 2, 3 and 4 in each case where both filters were oriented at 0° specular reflections appeared on the image as white spots on a black background. However, when the second filter was oriented at 90° in accordance with the invention, the specular reflections were substantially reduced.

As can be seen from FIG. 5 the specular reflections are reduced by employing a single polarizer, particularly when it is oriented at 90° as defined above.

The enhancement of contrast by minimizing specular reflection in copies made according to the invention may be achieved by using any type of original documents, including originals which are xerographically printed, or printed by offset printing, impact printing, letterpress printing, magnetographic printing, or printed in pencil graphite.

In order to provide a measure of the improvement in the contrast which could be obtained between paper and toner, a duplicate of the optical system in the Ricoh Company 6400 copier was constructed on an optical bench. The intensity of the light received at the image plane when reflected from both the toner and blank photocopying paper was determined for various conditions. This required considerable instrumentation and the results are reproduced in Tables 1, 2, 3, 4, and 5.

TABLE 1

REDUCTION OF INTENSITY REFLECTED FROM TONER
Reflected Path - 2 Filters

| Angular Orientation of Second Filter | Flux at Image Plane ($\times 10^{-2}$ $\mu$w/cm$^2$) | Percent Reduction of Intensity |
|---|---|---|
| 0° | 8.30 | — |
| 90° | 3.90 | 53.1% |

TABLE 2

REDUCTION OF INTENSITY REFLECTED FROM PHOTOCOPYING PAPER
Reflected Path - 2 Filters

| Angular Orientation of Second Filter | Flux at Image Plane ($\times 10^{-1}$ $\mu$w/cm$^{-2}$) | Percent Reduction of Intensity |
|---|---|---|
| 0° | 15.70 | — |
| 90° | 13.80 | 12.1% |

TABLE 3

STRAIGHT-LINE PATH TRANSMITTANCE THROUGH POLARIZERS
(No Specular Reflection)

| Number of Filters | Angle Between Axes of Filters | Flux Transmitted ($\times$ 10 $\mu$w/cm$^2$) | % Transmittance |
|---|---|---|---|
| 0 | — | 12.00 | 100 |
| 1 | — | 2.67 | 22.3 |
| 2 | 0° | 1.23 | 10.3 |
| 2 | 90° | 0.10 | 0.8 |

TABLE 4

REDUCTION OF INTENSITY REFLECTED FROM TONER
Reflected Path - One Filter

| Angular orientation of filter axis with respect to the plane of polarized specular reflections | Flux ($\times 10^{-1}$ $\mu$w/cm$^2$) | % Reduction Intensity |
|---|---|---|
| 0° | 3.32 | 0% |
| 30° | 3.14 | 5.3 |
| 45° | 2.91 | 12.4 |
| 60° | 2.65 | 20.1 |
| 75° | 2.54 | 23.5 |
| 90° | 2.45 | 26.2 |

TABLE 5

REDUCTION OF INTENSITY REFLECTED FROM PHOTOCOPYING PAPER
Reflected Path - One Filter

| Angular orientation of filter axis with respect to polarized specular reflection | Flux ($\mu$w/cm$^2$) | Reduction in Intensity |
|---|---|---|
| 0° | 6.28 | 0% |
| 30° | 6.22 | 1.0 |
| 45° | 6.12 | 2.6 |
| 60° | 6.00 | 4.4 |
| 75° | 5.92 | 5.7 |
| 90° | 5.85 | 6.9 |

Tables 1 and 2 are the results obtained with 2 polarizers inserted in the optical path, one between the light source and the document in copying position, and the other in the path between this document and the photoreceptor. The angles relate the axis of the 2 polarizers. Table 1 presents the results when the original is a xerographic reproduction and the reflections are from a toner surface. Table 2 presents the results from a paper surface. This experiment shows that the contrast, the ratio of the light in the image plane received from the paper divided by that received from the paper, with the filters in the 0° position is 19, while the contrast with the filters in the 90° position is 35.4. The increase is 86%.

Table 4 and 5 present comparable results where only a single polarizer is placed in the optical path between the document being copied and the image plane. In this case the angle refers to the angle of the axis of the polarizer to the plane of the scanning slit. The results indicate the contrast at 0° to be 17.6 or slightly less than that for the 2 polarizers. This contrast progressively increases as the polarizer is rotated to the 90° position. At this point the contrast is 25 for an increase of 45%.

Table 3 portrays the effect of the insertion of the polarizer into the optical path on the intensity of the light arriving at the same image plane. It is readily apparent that as each polarizer is introduced into the light path a reduction in intensity occurs. This reduction in intensity must be compensated for by some means, either increased sensitivity or by a more intense light source. Table 3 indicates that the compensation in the one polarizer case must increase the intensity at the image plane by a factor of 4 and in the two crossed filter case by a factor of 100.

Technology today in optics and photoconductors make both of these increases in intensity difficult to obtain, and the factor of 10 is almost unattainable. The improvement in the contrast of the one filter case of almost 50% coupled with the lower reduction of intensity by a factor of 2.5 makes this the preferred arrangement. It should also be noted that the reduction of the light reflected in the image areas by 50% is not a uniform reduction over all areas. FIGS. 4 and 5 show that this reduction is very localized and its impact on the imaging process is considerably greater than indicated by these measurements.

What is claimed is:

1. In a photocopying apparatus, comprising a light source, a reflection plane, optical elements to focus the light and an image plane;

the improvement comprising;

a light polarizing means juxtaposed between said reflection plane and said image lane;

whereby specularly reflected polarized light from said reflection plane directed toward said image plane is prevented from being incident upon said image plane by said polarizing means.

2. In a photocopying apparatus, comprising a light source, a reflection plane and an image plane;

the improvement comprising;

a light polarizing means juxtaposed between said reflection plane and said image plane;

whereby specularly reflected polarized light from said reflection plane directed toward said image plane is prevented from being incident upon said image plane by said polarizing means.

3. The apparatus according to claim 1 wherein said polarizing means is oriented with its polarizing axis at 90° with respect to the plane of said specularly reflected polarized light.

4. In a photocopying apparatus, comprising a light source, a reflection plane, optical elements to focus the light and an image plane;

the improvement comprising a first light polarizing means juxtaposed between said light source and said reflection plane thereby causing only polarized light to be incident upon said reflection plane;

and a second light polarizing means juxtaposed between said reflection plane and said image plane, said second polarizing means having its polarizing axis oriented 90° with respect to the polarizing axis of said first light polarizing means;

whereby specularly reflected polarized light from said reflection plane directed toward said image plane is prevented from being incident upon said image plane by said second polarizing means.

5. In a photocopying apparatus, comprising a light source, a reflection plane and an image plane;

the improvement comprising a first light polarizing means juxtaposed between said light source and said reflection plane thereby causing only polarized light to be incident upon said reflection plane;

and a second light polarizing means juxtaposed between said reflection plane and said image plane, said second polarizing means having its polarizing axis oriented 90° with respect to the polarizing axis of said first light polarizing means;

whereby specularly reflected polarized light from said reflection plane directed toward said image plane is prevented from being incident upon said image plane by said second polarizing means.

6. A method for eliminating specular light reflection upon the image plane of a photocopying apparatus comprising a light source, a reflection plane, optical elements to focus the light and said image plane;

said method comprising projecting the light reflected from said reflection plane through a light polarizing means juxtaposed between said reflection plane and said image plane;

whereby specularly reflected polarized light from said reflection plane directed toward said image plane is prevented from being incident upon said image plane by a light polarizing means.

7. A method for eliminating specular light reflection upon the image plane of a photocopying apparatus comprising a light surce, a reflection plane, and said image plane;

said method comprising projecting the light reflected from said reflection plane through a light polarizing means juxtaposed between said reflection plane and said image plane;

whereby specularly reflected polarized light from said reflection plane directed toward said image plane is prevented from being incident upon said image plane by a light polarizing means.

8. The method according to claim 6 or 7 wherein said polarizing means is oriented with its polarizing axis at 90° with respect to the plane of said specularly reflected polarized light.

9. The method according to claim 8 wherein said reflection plane consists of a sheet of paper having areas of print thereon, said print comprising microscopic, irregularly-shaped specular particles.

10. The method according to claim 9 wherein said print is produced xerographically.

11. The method according to claim 9 wherein said print is produced by offset printing.

12. The method according to claim 9 wherein said print is produced by impact printing.

13. The method according to claim 9 wherein said print is produced by letterpress printing.

14. The method according to claim 9 wherein said print is produced by magnetographic printing.

15. The method according to claim 9 wherein said print comprises pencil graphite.

16. A method for eliminating specular light reflection upon the image plane of a photocopying apparatus comprising a light source, a reflection plane, optical elements to focus the light and said image plane;

said method comprising projecting the light from said light source through a first light polarizing means juxtaposed between said light source and said reflection plane thereby causing only polarized light to be incident upon said reflection plane;

whereby specularly reflected polarized light from said reflection plane directed toward said image plane is prevented from being incident upon said image plane by a second light polarizing means juxtaposed between said reflection plane and said image plane, said second polarizing means having its polarizing axis oriented 90° with respect to the polarizing axis of said first light polarizing means.

17. A method for eliminating specular light reflection upon the image plane of a photocopying apparatus comprising a light source, a reflection plane, and said image plane;

said method comprising projecting the light from said light source through a first light polarizing means juxtaposed between said light source and said reflection plane thereby causing only polarized light to be incident upon said reflection plane;

whereby specularly reflected polarized light from said reflection plane directed toward said image plane is prevented from being incident upon said image plane by a second light polarizing means juxtaposed between said reflection plane and said image plane, said second polarizing means having its polarizing axis oriented 90° with respect to the polarizing axis of said first light polarizing means.

18. The method according to claim 16 or 17 wherein said reflection plane consists of a sheet of paper having areas of print thereon, said print comprising microscopic, irregularly-shaped specular particles.

19. The method according to claim 18 wherein said print is produced xerographically.

20. The method according to claim 18 wherein said print is produced by offset printing.

21. The method according to claim 18 wherein said print is produced by impact printing.

22. The method according to claim 18 wherein said print is produced by letterpress printing.

23. The method according to claim 18 wherein said print is produced by magnetograhic printing.

24. The method according to claim 18 wherein said print comprises pencil graphite.

* * * * *